US007466224B2

(12) United States Patent
Ward et al.

(10) Patent No.: US 7,466,224 B2
(45) Date of Patent: Dec. 16, 2008

(54) SYSTEM FOR DETECTING INTRUDERS IN A POPULATED SPACE

(75) Inventors: Andrew Martin Robert Ward, Cambridge (GB); Paul Michael Webster, Cambridge (GB); Rupert William Meldrum Curwen, Hertfordshire (GB); Peter Joseph Steggles, Cambridge (GB)

(73) Assignee: Ubisense Limited, Cambridge (GB)

( * ) Notice: Subject to any disclaimer, the term of this patent is extended or adjusted under 35 U.S.C. 154(b) by 306 days.

(21) Appl. No.: 11/161,160

(22) Filed: Jul. 25, 2005

(65) Prior Publication Data

US 2007/0001835 A1 Jan. 4, 2007

(51) Int. Cl.
*G08B 19/00* (2006.01)

(52) U.S. Cl. ..... 340/522; 340/540; 340/541; 340/528; 340/545.1; 340/556; 340/572.1; 340/572.4; 340/573.4; 340/5.2; 340/686.6; 340/825.49

(58) Field of Classification Search ..... 340/522, 340/540, 541, 528, 545.1, 556, 571.1, 572.4, 340/573.4, 5.2, 686.6, 825.49
See application file for complete search history.

(56) References Cited

U.S. PATENT DOCUMENTS 5,541,585 A * 7/1996 Duhame et al. ..... 340/5.62
6,111,502 A * 8/2000 Lenglart et al. ..... 340/541
6,720,874 B2 * 4/2004 Fufido et al. ..... 340/541
2003/0076230 A1 * 4/2003 Runyon et al. ..... 340/572.1
2003/0197612 A1 * 10/2003 Tanaka et al. ..... 340/572.1

FOREIGN PATENT DOCUMENTS

EP 0622761 A2 11/1994
FR 2571419 4/1986
WO WO 02/23498 A1 3/2002

OTHER PUBLICATIONS

Michael D. Addlesse, et al. "The ORL Active Floor" *IEEE Personal Communications*, vol. 4, No. 5, Oct. 1997, pp. 35-41.

* cited by examiner

*Primary Examiner*—Tai Nguyen
(74) *Attorney, Agent, or Firm*—Novak Druce DeLuca & Quigg LLP

(57) ABSTRACT

A system for monitoring the presence of persons within a zone, the system comprising: one or more remotely detectable markers, each capable of being carried by a person; a first sensor arrangement capable of identifying the presence of the body of at least one person within the zone; a second sensor arrangement capable of identifying the presence of at least one marker within the zone; and a processing arrangement responsive to the first sensor arrangement and the second sensor arrangement to generate an alarm signal if the first sensor arrangement identifies the presence of a body without the second sensor arrangement identifying a marker corresponding in a first predetermined manner to that body.

19 Claims, 8 Drawing Sheets

SYSTEM FOR DETECTING INTRUDERS IN A POPULATED SPACE

CROSS-REFERENCE TO RELATED APPLICATIONS

The present patent application is a National Stage filing under 35 U.S.C. 371 of International Application No. PCT/GB2004/000331 filed 26 Jan. 2004 which claims priority to GB Application No. 0301790.0 filed 25 Jan. 2003; the entire disclosures of which are incorporated herein by reference.

TECHNICAL FIELD

This invention relates to a security system for detecting intruders in a populated space.

BACKGROUND OF INVENTION

There are many instances in which it is desirable to monitor a sensitive area of a building, installation or other indoor or outdoor space for the presence of unauthorized intruders. Some known arrangements for this purpose will now be discussed.

GE Interlogix Sensors and Detectors, of 12345 SW Leveton Dr., Tualatin, Oreg. 97062, U.S.A. manufactures a break-glass sensor known as the '5150 Shock Sensor' designed to raise an alarm when an intruder attempts to gain entry to a sensitive area by breaking a window on its perimeter. Any attempt to break the window bends a piezoelectric element in the sensor, and the electric current generated by the element in response is detected by a monitoring circuit which triggers an alarm circuit. However, this device only monitors certain points around the perimeter of the restricted space (the windows). If an intruder gains access to the space by, for example, following an authorized person through a security door without being challenged, this device can provide no indication that a security breach has occurred.

Alarm Lock, of 345 Bayview Avenue, Amityville, N.Y. 11701, U.S.A., manufactures a door alarm device known as the 'SirenLock PG21'. This device is a lock containing a magnetic reed switch, which is affixed to the door to be monitored, coupled with a magnet that is attached to the frame of the door to be monitored. When the door is opened, the switch is moved away from the magnet, and the switch opens—if the person opening the door has not disabled the lock using a key, this action activates an alarm circuit to indicate an unauthorized entry. Again, this device only monitors certain areas around the perimeter of the restricted space (the doors), and cannot bring the presence of unauthorized people within the space to the attention of security personnel via an alarm.

Texecom Limited, of Texecom House, 559 Wilbraham Road, Manchester M21 0AE, Great Britain, manufactures a passive infra-red detection device known as the 'Reflex'. The device comprises an infra-red sensitive element placed behind a lens with a certain field-of-view. A monitoring circuit samples the electrical properties of the element, which change when infra-red light of the correct wavelength (that of the infra-red light emitted by the human body) falls on to it. When a person walks into the field-of-view of the device, the infra-red energy emitted by their body is picked up by the sensor, and the monitoring circuit detects the resulting change in the sensor's electrical properties, triggering an alarm. Because the sensor reacts to all people entering the sensor's field-of-view, it can only be used during periods when no authorized personnel will be present in the area covered.

Therefore, these sensors are typically used to monitor areas within a sensitive space outside of normal operating or working hours.

Kalatel Inc., of 4575 Research Way, STE 250, Corvallis, Oreg. 97333, U.S.A. manufactures a video surveillance system known as the 'Digiplex' system that allows operators to view images captured by a set of cameras placed around a sensitive space. An operator may be able to use the system to spot an intruder in a camera image amongst the authorized users of that space, but for the system to be effective during periods when authorized users are likely to be present in the sensitive area (for example, during the day) the operators must be able to identify all authorized users on sight. Furthermore, the use of human operators (rather than an automated monitor) will result in relatively high running costs for the system.

Whilst these security sensors can monitor either the perimeter of a sensitive space at all times, or regions within that space at certain times when no authorized personnel are present, they are unable to effectively monitor regions within a space populated by authorized personnel for the presence of intruders.

The invention seeks to overcome at least some of the disadvantages of the prior art.

DISCLOSURE OF INVENTION

According to an aspect of the present invention there is provided a system for monitoring the presence of persons within a zone, the system comprising: one or more remotely detectable markers, each capable of being carried by a person; a first sensor arrangement capable of identifying the presence of the body of at least one person within the zone; a second sensor arrangement capable of identifying the presence of at least one marker within the zone; and a processing arrangement responsive to the first sensor arrangement and the second sensor arrangement to generate an alarm signal if the first sensor arrangement identifies the presence of a body without the second sensor arrangement identifying a marker corresponding in a first predetermined manner to that body.

According to an aspect of the present invention there is provided a method for monitoring the presence of persons within a zone by means of one or more remotely detectable markers, the method comprising: identifying the presence of the body of at least one person within the zone; identifying the presence of at least one marker within the zone; and generating an alarm signal if the first sensor arrangement identifies the presence of a body without the second sensor arrangement identifying a marker corresponding in a first predetermined manner to that body.

The alarm signal may cause an alarm to be sounded, or may be used to trigger another state in other equipment, for example to cause a camera that views the zone to be actuated.

Preferably each marker has a unique identity. Suitably the unique identity can be sensed remotely. Thus, preferably the presence and/or the identity of each marker can be sensed from a range greater than 20 cm, 50 cm, 1 m, or preferably 2 m. Preferably the presence and/or identity of each marker can be sensed without line of sight contact between the marker and the reader: for example though clothing or the material of a handbag. Preferably each marker is adapted to be carried on a person, for example by being equipped with a clip or other pinching and/or gripping means.

The second sensor arrangement is preferably capable of sensing the identity of a marker that is located within the zone.

The processing arrangement preferably has access to a data store storing the identities of markers permitted in the zone.

The data store may be co-located with the processing arrangement or remotely located and accessible to the processing arrangement via a data network. The processing arrangement is preferably arranged to generate an alarm signal if the identity of a marker sensed in the zone by the second sensor arrangement is not that of a marker that is permitted in the zone.

The system may comprises a third sensor arrangement for sensing an attribute of the or each person within the zone. In that instance the processing arrangement preferably has access to a data store storing for each marker one or more characteristics associated with that marker and is arranged to generate an alarm signal if the sensed attribute(s) do not correspond in a second predetermined manner to the characteristic(s) stored for the marker(s) sensed in the zone.

The attribute may be weight. The characteristic is suitably an indication of the weight of a person associated with the respective marker. That person has preferably been pre-registered as the user or carrier of that marker. Instead of or in addition to weight, one or more other attributes may be used. The or each such attribute is conveniently one that permits identification of a particular person to a reasonable level of probability. Thus the attribute is preferably automatically detectable, preferably permits differentiation between people, and is preferably resistant to simulation or concealment by an individual who might want to defeat the security system. Examples of such attributes include height, hair or skin color, gait, fingerprints, iris pattern or body odor. These could be detected by suitable detection systems such as a series of vertically offset optical beams and associated detectors, digital cameras connected to image analysis apparatus, floor-mounted force transducers connected to time-based analysis equipment, electronic fingerprint detectors or electrochemical sensors.

The characteristic is an indication of the type of a person associated with the respective marker, and the processing arrangement may be arranged to estimate the weight of the person based on that indication. Such a characteristic may, for instance be the sex of the person.

The second predetermined manner may be such that if the weight sensed by the third sensing means differs by more than a predetermined threshold from the weight of the person as derived from the characteristic associated with the or each marker sensed in the zone then the sensed attribute does not correspond to the characteristic.

The first predetermined manner may be such that a marker does not correspond in the first predetermined manner to a body if the number of marker(s) identified in the zone at a time exceeds the number of markers sensed in the zone at the time.

The zone may be such that only one person can be present in the zone at a time. This may be achieved by restricting the size of the zone using walls, doors etc., or by preventing entry to the zone if there is a person in it by means of an air-lock-type arrangement.

The first sensor arrangement may be capable of determining the number of bodies of people within the zone. It may be an infra-red people counter.

Preferably the first sensor arrangement is capable of characterizing the location of the body of at least one person within the zone, the second sensor arrangement is capable of characterizing the location of at least one marker within the zone; and the first predetermined manner is such that a marker does not correspond in the first predetermined manner to a body if no marker is identified having the characterized location at which the body is identified.

A location may be characterized as a bearing from a respective sensor arrangement or a distance from a respective sensor arrangement. In this case the sensor arrangements are preferably located at points adjacent to each other. A location may be fully characterized within the zone, for example by means of both range and direction from a sensor arrangement.

The zone may be located at the periphery of a space. In that case the first sensor arrangement may be capable of identifying whether a body is moving towards or away from the space, and the first predetermined manner is such that an alarm signal is generated if the body to which a marker does not correspond is moving towards the space. Preferably an alarm signal is not generated otherwise.

The first sensor arrangement may be capable of sensing weight, suitably the weight bearing on the floor of the zone. The first predetermined manner may then be such that an alarm signal is generated if the sensed weight does not correspond to that associated with any detected marker(s) in the zone. The weight associated with a marker may be determined in one of the ways described above in relation to the third sensor arrangement.

Each marker may have an active state and a low power state in which it uses less power than in the active state. The system may comprise means for causing a marker to enter the active state on entry into the zone. Preferably each marker has a portable supply of electrical power, for example a battery, attached thereto.

Preferably each marker is remotely detectable by means of radio frequency communication.

Each tag may be a radio frequency transponder.

Each sensor arrangement may comprise one or more sensor devices, which most preferably cooperate to collectively provide coverage over the whole of the zone.

It is preferred that each sensor arrangement has coverage of the whole of the zone, and that its coverage is substantially coterminous with the zone. Thus preferably it can detect substantially throughout the zone but no further.

According to an aspect of the invention, there is provided a system for detecting the presence of unauthorized people within an area populated by authorized people, the system comprising of: a plurality of markers, which may or may not have a unique identifier, and which are carried, at least one-per-person, by authorized people; a reader capable of sensing the presence, and identity if it has one, of a marker carried by an authorized person within some area; a detector capable of sensing the presence of people within the field-of-coverage of that sensor; and a processing unit; wherein the effective field-of-coverage of the detector is completely contained within the effective field-of-coverage of the reader, and both the detector and reader are connected to the processing means, and the processing means is capable of raising an alarm should the detector sense the presence of a person but the reader not sense the presence of a marker.

It will be appreciated that when an authorized person enters the zone (or field-of-coverage) of the first sensing arrangement (or detector), their presence can be sensed by both the detector—which preferably senses all people within the zone—and the second sensing arrangement (or reader)—which will detect the presence of the marker, or markers, carried by the individual). However, when an unauthorized person enters the field-of-coverage of the detector, their presence will be sensed only by the detector, because they do not carry a marker. Therefore, an alarm can be raised by the processing unit if the detector senses the presence of a person, but the reader does not sense the presence of a marker associated with them.

In a further preferred feature of the invention, if the reader is capable of sensing not only the presence of a marker within the zone, but also the number of such markers, and the detector is capable of sensing not only the presence of people within its field-of-view, but also the number of such people (or that number can be estimated from the detector output), then a more stringent security test can be carried out by the system. An alarm can be raised by the processing unit if the detector senses the presence of more people than there are markers identified by the reader, because at least one person who is not carrying a marker must be present within the area covered by both the detector and the reader.

In a further preferred feature of the invention, if the reader is capable of sensing not only the presence of markers within some area, but also the location (either the three-dimensional location or a less precise characterization thereof such as its range or bearing from a known point) of those markers, and the detector is capable of sensing not only the presence of people within its field-of-view, but also the locations (or ranges, or bearings) of those people relative to the same point or another point the offset of which from the first point is known (and preferably zero), then a still more stringent security test can be carried out by the system. An alarm can be raised by the processing unit if the detector senses the presence of one or more people at a particular location (or range, or bearing) where the reader does not detect the presence of a marker, because at least one person who is not carrying a marker must be present at that location (or at that range, or on that bearing).

In a further preferred feature of the invention, a signal may be transmitted by the system to battery-powered markers carried by authorized personnel to wake them from a low-power state when they are in the vicinity of the field-of-coverage of the reader, allowing them to conserve battery power whilst they are not in the space covered by the security system.

In a further preferred feature of the invention, if the reader is capable of sensing not only the presence and the number, but also the identities of markers within its area of coverage, then a still more stringent security test can be carried out by the system. The processing unit can disregard, for the purposes of counting the number of authorized people present (either in the space covered by the security system, or at a location, or at a range, or on a bearing), any marker with an identifier not contained in a list of marker identities, stored by the reader, which corresponds to those markers carried by people authorized to be present in that area of the building, installation or other space at that time.

In a further preferred feature of the invention, if the reader is capable of sensing not only the presence and the number, but also the identities of markers within its area of coverage, and the processing unit stores the expected weight of the person associated with each marker, and the detector is a weight sensor, then a heuristic can be used by the processing unit to help determine whether or not an alarm condition should be signaled. If the total of the expected weights of the authorized people sensed by the reader differs from the weight signal output by the detector by more than some pre-set limit, an alarm is signaled by the processing unit.

BRIEF DESCRIPTION OF THE DRAWINGS

Embodiments of the invention will now be more particularly described, by way of example only, with reference to the accompanying figures, which show schematic overviews of embodiments of the invention.

In the figures.

DETAILED DESCRIPTION

Figure 1:
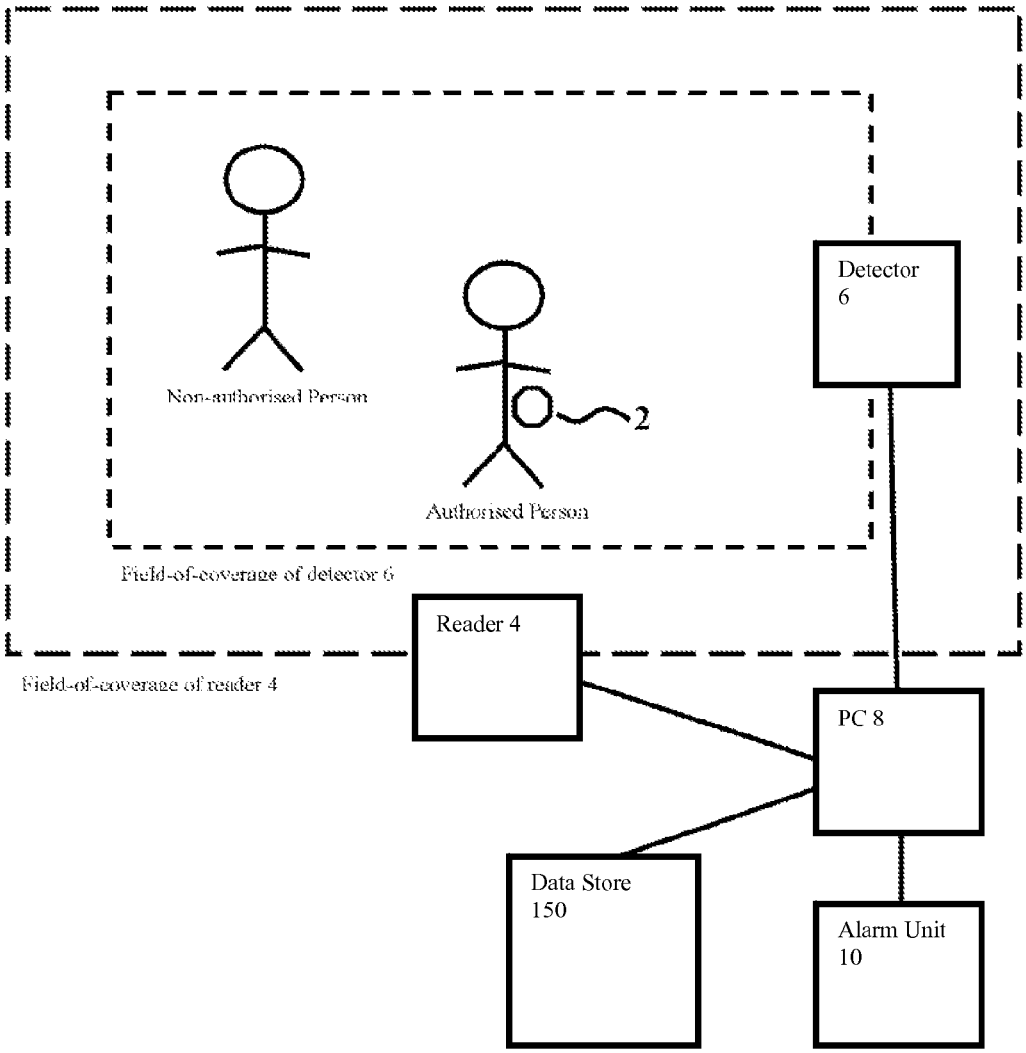
FIG. 1 shows a first embodiment of an intruder detection system.

In a first embodiment (shown in FIG. 1), authorized personnel carry a marker 2, which comprises a small radio frequency identification (RFID) tag. The preferred type of RFID tag is an 'HT1' tag manufactured by Sokymat SA of Zone Industrielle CH 1614 Granges (Veveyse) Switzerland.

A reader unit 4, and a detector unit 6, are connected to an IBM-compatible PC 8, which, in turn, is connected to an alarm system 10. The preferred type of reader unit 4 is a HT CM800 with long-range antenna, supplied by ACG AG, Dantestrasse 4-6, D-65189, Wiesbaden, Germany. The preferred type of detector unit 6 is a 'Reflex' passive infra-red detector, manufactured by Texecom Limited, of Texecom House, 559 Wilbraham Road, Manchester M21 0AE, and mounted so as to cover the same area as the reader unit. The coverage areas of each may also be limited by the physical environment set up around the sensor: for example by means of walls, doors etc. that result in the zones of coverage of the two sensors being substantially coterminous.

When the detector 6 signals the software running on the PC 8 that a person is present in its field-of-coverage, the PC software checks the output of the reader unit 4 to determine whether one or more markers 2 are present in the field-of-coverage of the reader unit 4. If no markers are present, an unauthorized person has entered the space covered by the reader unit 4 and the detector 6, and so the software running on the PC 8 triggers the alarm system 10.

A data store 150 may be provided in any of the embodiments described herein for storing data that can be used by the PC for its operations.

Other technologies may be substituted for the marker 2 and reader unit 4, for example the 'Copytag LR' active tag and 'CTCR1' reader unit supplied by Copytag Limited of 1A Upper Hook Harlow Essex CM18 6PX United Kingdom. Other technologies may be substituted for the detector unit 6, for example, a weight-sensitive pressure mat such as the '902R' mat manufactured by United Security Products Inc. of 11025 Sorrento Valley Court, San Diego, Calif. 92121, U.S.A., a light-beam-break detector such as the 'PR10-B' manufactured by Pulnix Europe Ltd of Pulnix House, Aviary Court, Wade Road, Basingstoke, Hampshire, RG24 8PE, United Kingdom, an infra-red people counter such as the 'IRC1004/0' manufactured by IRISYS of Towcester Mill, Towcester, Northants, NN12 6AD, United Kingdom, or a radar unit such as the short-range 24 GHz radar developed by smart microwave sensors GmbH of Mittelweg 7, Braunschweig, Niedersachsen D-38106, Germany.

The PC suitably comprises a data processor. The PC could be replaced by a dedicated processing means.

Figure 2:
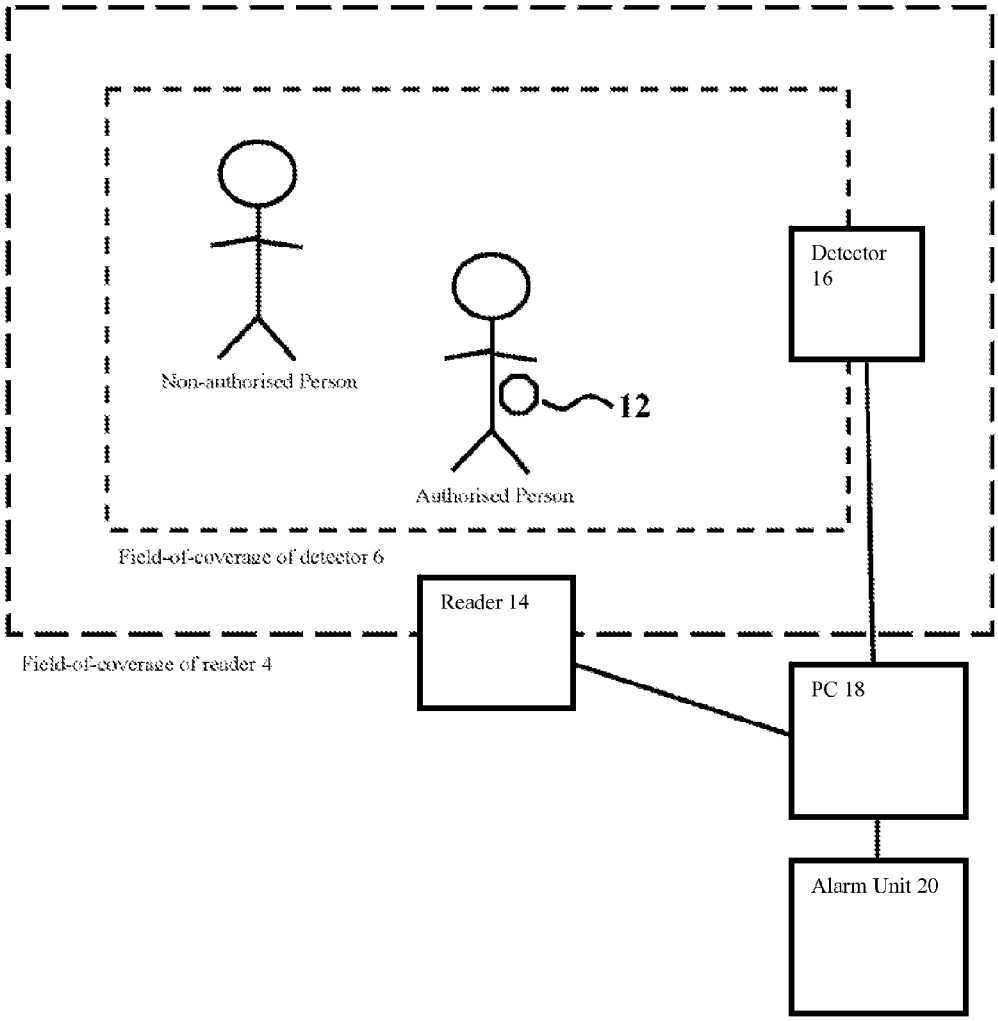
FIG. 2 shows a second embodiment of an intruder detection system.

In a second embodiment of the invention (shown in FIG. 2), the system is capable of determining the number of markers and unauthorized people within the area it covers. Authorized personnel carry a marker 12, which comprises a small radio frequency identification (RFID) tag. The preferred type of RFID tag is an 'HT1' tag manufactured by Sokymat SA of Zone Industrielle CH 1614 Granges (Veveyse) Switzerland.

A reader unit 14, and a detector unit 16, are connected to an IBM-compatible PC 18, which, in turn, is connected to an alarm system 20. The preferred type of reader unit 14 is an 'HT CM800' with long-range antenna, supplied by ACG AG, Dantestrasse 4-6, D-65189, Wiesbaden, Germany. The preferred type of detector unit 16 is a radar unit such as the short-range 24 GHz radar developed by smart microwave sensors GmbH of Mittelweg 7, Braunschweig, Niedersachsen D-38106, Germany.

When the detector 16 signals the software running on the PC 18 that one or more people are present in its field-of-coverage, the PC software checks the output of the reader unit 14 to determine whether one or more markers 12 are present in the field-of-coverage of the reader unit 14. If the number of markers present is less than the number of people sensed by the detector, an unauthorized person has entered the space covered by the reader unit 14 and the detector 16, and so the software running on the PC 18 triggers the alarm system 20.

Other technologies may be substituted for the marker 12 and reader unit 14, for example the 'Copytag LR' active tag and 'CTCR1' reader unit supplied by Copytag Limited of 1A Upper Hook Harlow Essex CM18 6PX United Kingdom.

Figure 3:
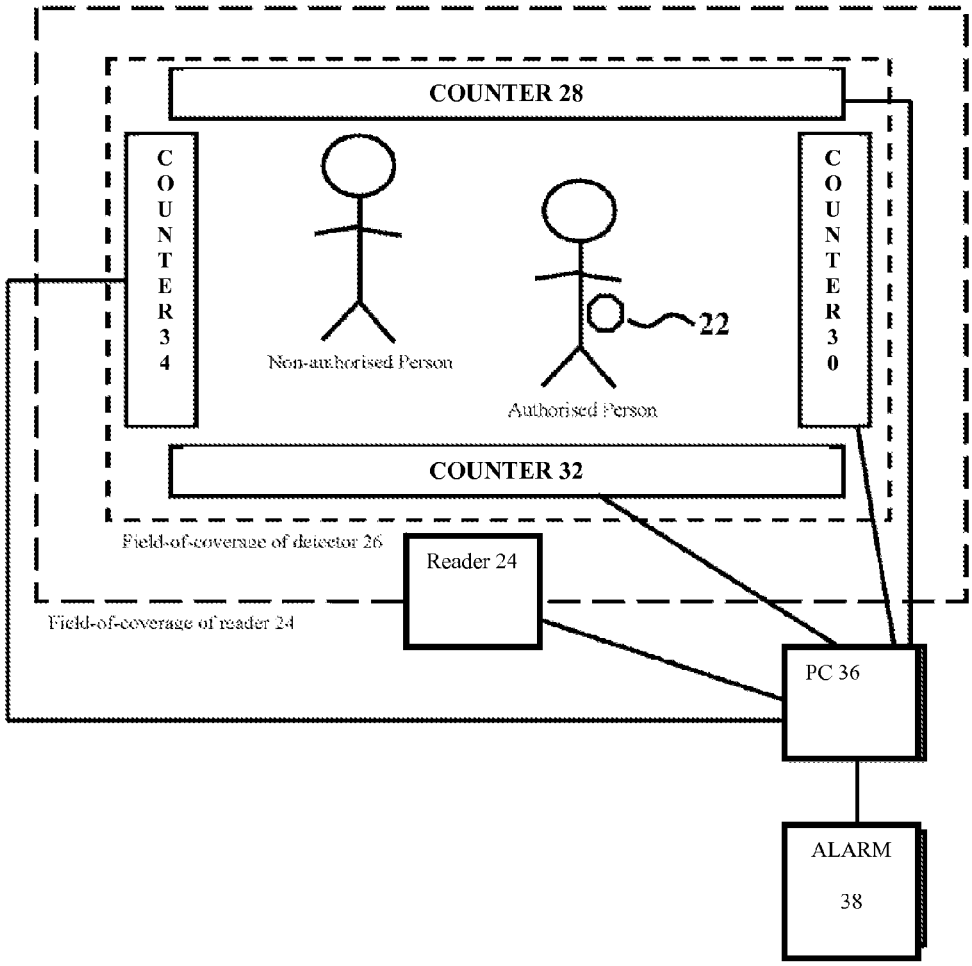
FIG. 3 shows a third embodiment of an intruder detection system.

In a third embodiment of the invention (shown in FIG. 3), the system is again capable of determining the number of markers and unauthorized people within the area it covers. Authorized personnel carry a marker 22, which comprises a small radio frequency identification (RFID) tag. The preferred type of RFID tag is an 'HT1' tag manufactured by Sokymat SA of Zone Industrielle CH 1614 Granges (Veveyse) Switzerland.

A reader unit 24, and a detector 26 comprising a number of infra-red people counters, 28, 30, 32 and 34, are connected to an IBM-compatible PC 36, which, in turn, is connected to an alarm system 38. The preferred type of reader unit 24 is an 'HT CM800' with long-range antenna, supplied by ACG AG, Dantestrasse 4-6, D-65189, Wiesbaden, Germany. The preferred type of people counters 28, 30, 32 and 34 are the 'IRC1004/0' manufactured by IRISYS of Towcester Mill, Towcester, Northants, NN12 6AD, United Kingdom.

Each person counter 28, 30, 32 and 34 in the detector 26 generates an 'in' signal when a person passes in one direction across its field-of-view, and a 'out' signal when a person passes in the other direction across its field-of-view. Software running on the PC 36 takes in readings from the people counters 28, 30, 32 and 34 to maintain a count of the number of people within the area bounded by the people counters—each time an 'in' signal is received the count is increased, and each time an 'out' signal is received the count is decreased. (It is assumed that no people will, initially, be in the monitored area, and the initial count is set to zero).

When the software running on the PC 36 notes that the count of people in the monitored area is greater than zero, it checks the output of the reader unit 24 to determine whether one or more markers 22 are present in the field-of-coverage of the reader unit 24. If the number of markers present is less than the number of people counted to be in the monitored area, an unauthorized person has entered the space covered by the reader unit 24 and bounded by the infra-red people counters 28, 30, 32, and 34 and so the software running on the PC 36 triggers the alarm system 38.

Figure 4:
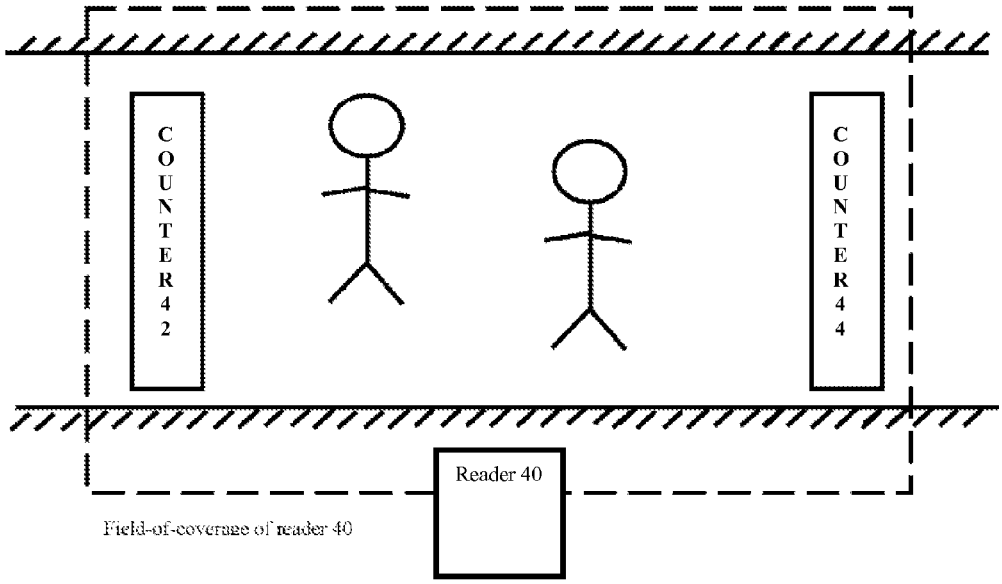
FIG. 4 shows a fourth embodiment of an intruder detection system.

In some circumstances, a greater or lesser number of people counters may be required to bound the area covered by the reader unit. For example (shown in FIG. 4), if a reader unit 40 is set up to cover an area of a corridor, only two people counters, 42 and 44, will be required, one on each open side of the region covered by the reader unit 40.

Other technologies may be substituted for the marker 22 and reader unit 24, for example the 'Copytag LR' active tag and 'CTCR1' reader unit supplied by Copytag Limited of 1A Upper Hook Harlow Essex CM18 6PX United Kingdom.

Figure 5:
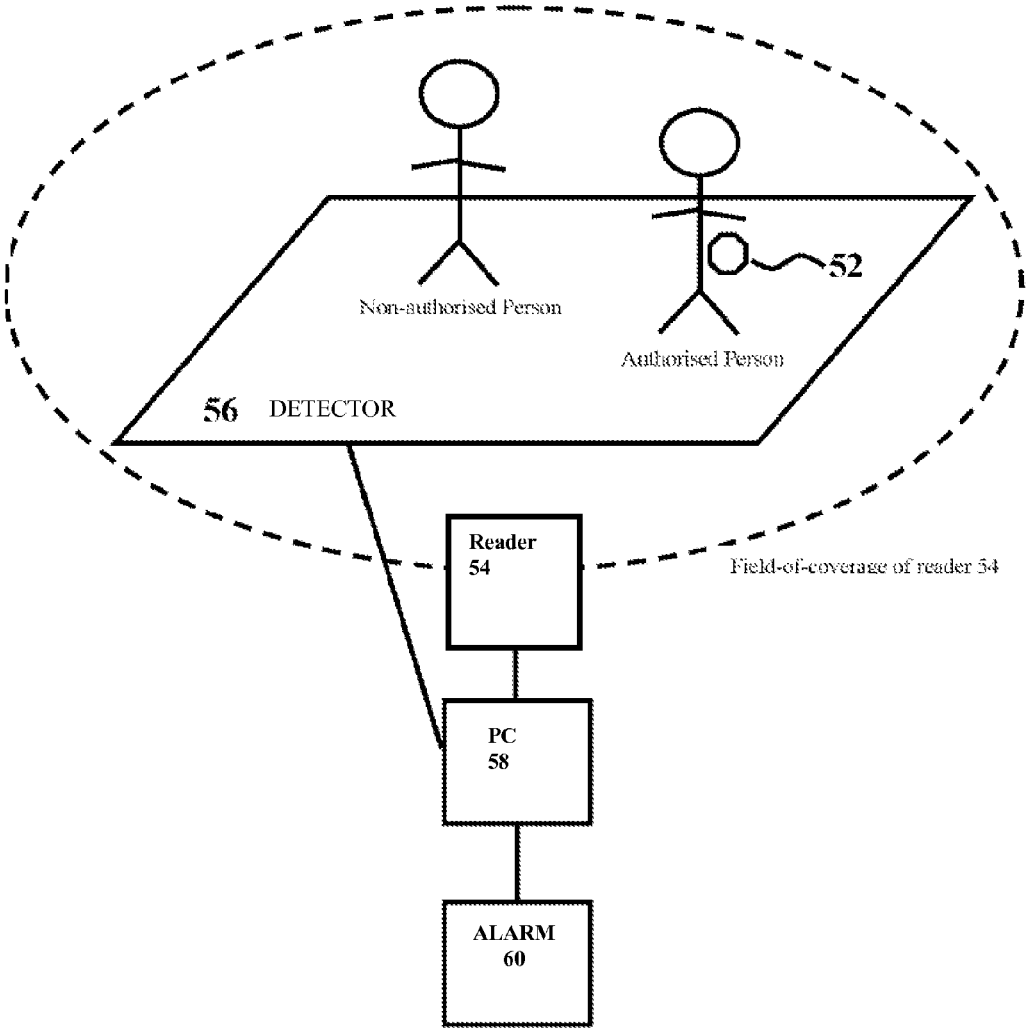
FIG. 5 shows a fifth embodiment of an intruder detection system.

In a fourth embodiment of the invention (shown in FIG. 5), the system is again capable of determining the number of markers and unauthorized people within the area it covers. Authorized personnel carry a marker 52, which comprises a small radio frequency identification (RFID) tag. The preferred type of RFID tag is an 'HT1' tag manufactured by Sokymat SA of Zone Industrielle CH 1614 Granges (Veveyse) Switzerland.

A reader unit 54, and a detector unit 56, are connected to an IBM-compatible PC 58, which, in turn, is connected to an alarm system 60. The preferred type of reader unit 54 is an 'HT CM800' with long-range antenna, supplied by ACG AG, Dantestrasse 4-6, D-65189, Wiesbaden, Germany. The preferred type of detector unit 56 is a '9253' force plate manufactured by Kistler Instruments Ltd., Alresford House, Mill Lane, Alton, Hampshire GU34 2QI, which is placed in the floor within the area of coverage of the reader unit 54.

When one or more people step on the detector 56, it signals the software running on the PC 58 that one or more people are present in the sensitive area, and the PC software checks the output of the reader unit 54 to determine whether one or more markers 52 are present in the field-of-coverage of the reader unit 54.

The PC software then determines the weight that would be expected to press down on the floor if the only people present were those associated with the markers 52 detected in the field-of-coverage of the reader unit 54. The software can do this in a number of ways. Firstly, it can multiply the number of markers detected by an average weight for people authorized to be in that area. Alternatively, if the reader unit 54 can determine the identifies of the markers 52 that it senses (as is the case for the preferred reader unit 54), it can use those identities, together with a stored list of the sexes or the known weights of the authorized individuals associated with each marker, to obtain a more accurate weight estimate—the software can multiply the number of markers known to be carried by men by an average weight for a male, and sum this with the number of markers known to be carried by females multiplied by an average weight for a female, or (if the information is available) it can sum the expected weights of the people associated with each marker.

The software running on the PC 58 then checks the estimated weight signature with the measured weight signature reported by the detector 56. If the weight signature reported by the detector 56 is greater than the expected weight signature by more than some pre-set error limit, an unauthorized person is likely to have entered the space covered by the reader unit 54 and the detector 56, and so the software running on the PC 58 triggers the alarm system 60.

Other technologies may be substituted for the marker 52 and reader unit 54, for example the 'Copytag LR' active tag and 'CTCR1' reader unit supplied by Copytag Limited of 1A Upper Hook Harlow Essex CM18 6PX United Kingdom.

Figure 6:
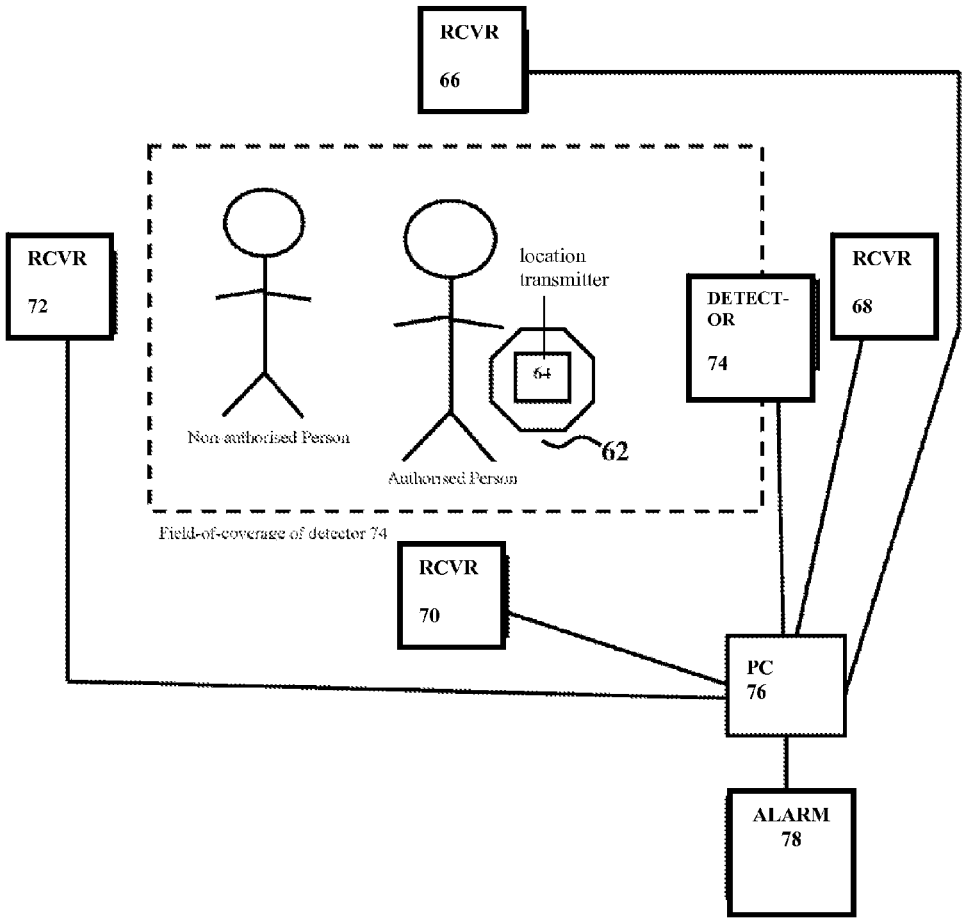
FIG. 6 shows a sixth embodiment of an intruder detection system.

In a fifth embodiment of the invention (shown in FIG. 6), the system is capable of determining the number and locations of markers and unauthorized people within the area it covers. Authorized personnel carry a marker with a unique identifier 62, which comprises a location sensor transmitter 64 and a 9V battery and power supply regulator (not shown).

A number of location sensor receivers 66, 68, 70 and 72 are placed in the environment, and are connected with a detector unit 74 to an IBM-compatible PC 76, which, in turn, is connected to an alarm system 78. The preferred type of location sensor 64, 66, 68, 70 and 72 is an ultra-wideband radio location sensor. One example of an ultra-wideband radio location sensor is that developed by the applicant hereof. Another example of such a sensor is that developed by Multispectral Solutions of 20300 Century Boulevard, Germantown, Md. 20874, U.S.A. The preferred type of detector unit 74 is a radar unit such as the short-range 24 GHz radar developed by smart microwave sensors GmbH of Mittelweg 7, Braunschweig, Niedersachsen D-38106, Germany.

The marker 62 continuously transmits signals containing its unique identifier via the location sensor transmitter 64. These signals are picked up by the fixed location sensor receivers 66, 68, 70 and 72, which pass details regarding those signals (such as the signal times-of-arrival and the marker identity encoded within each signal) to software running on the PC 76. The software running on the PC 76 uses these signal details to calculate the location of each marker tag within range of the location sensor receiver 66, 68, 70 and 72.

When the detector 74 signals the software running on the PC 76 to indicate that one or more people are present within its field-of-coverage, and passes the locations of those people to the PC software, the software checks the locations of the known authorized people against the locations of the people sensed by the detector 74. If the locations of one or more people sensed by the detector 74 are not matched by a corresponding marker location reported via the radio receiver 72, then an unauthorized person has entered the sensitive space, and so the software running on the PC 76 triggers the alarm system 78.

In some circumstances, a greater or lesser number of fixed location sensor receivers 66, 68, 70, 72 will be required to cover the sensitive area monitored by the security system. Furthermore, depending on the architecture of the location sensor subsystem 64, 66, 68, 70 and 72, it may not be possible or desirable for the software running on the PC 76 to calculate a full 2D or 3D location solution for the marker 62 and the software may only calculate a range or bearing of the marker from some point in space. It may also not be possible or desirable for the detector 74 to report the full 2D or 3D locations of people present within its field-of-coverage and the detector may only report the ranges or bearings of those people relative to some point in space. In such situations, a less stringent security check can still be made by the software running on the PC 76. The data generated by the software running on the PC 76 from the information sensed by the location sensor receivers 66, 68, 70 and 72, and the output from the detector 74, are transformed by the software (via standard geometrical procedures) into ranges or bearings from the same point. Then, when the detector 74 signals the software running on the PC 76 to indicate that one or more people are present within its field-of-coverage, the software checks the ranges or bearings of the known authorized people from some point against the ranges or bearings of the people sensed by the detector 74 from the same point. If the ranges or bearings of one or more people sensed by the detector 74 are not matched by a corresponding marker range or bearing determined using the information reported by the location sensor receivers 66, 68, 70 and 72, then an unauthorized person has entered the sensitive space, and so the software running on the PC 76 triggers the alarm system 78.

Figure 7:
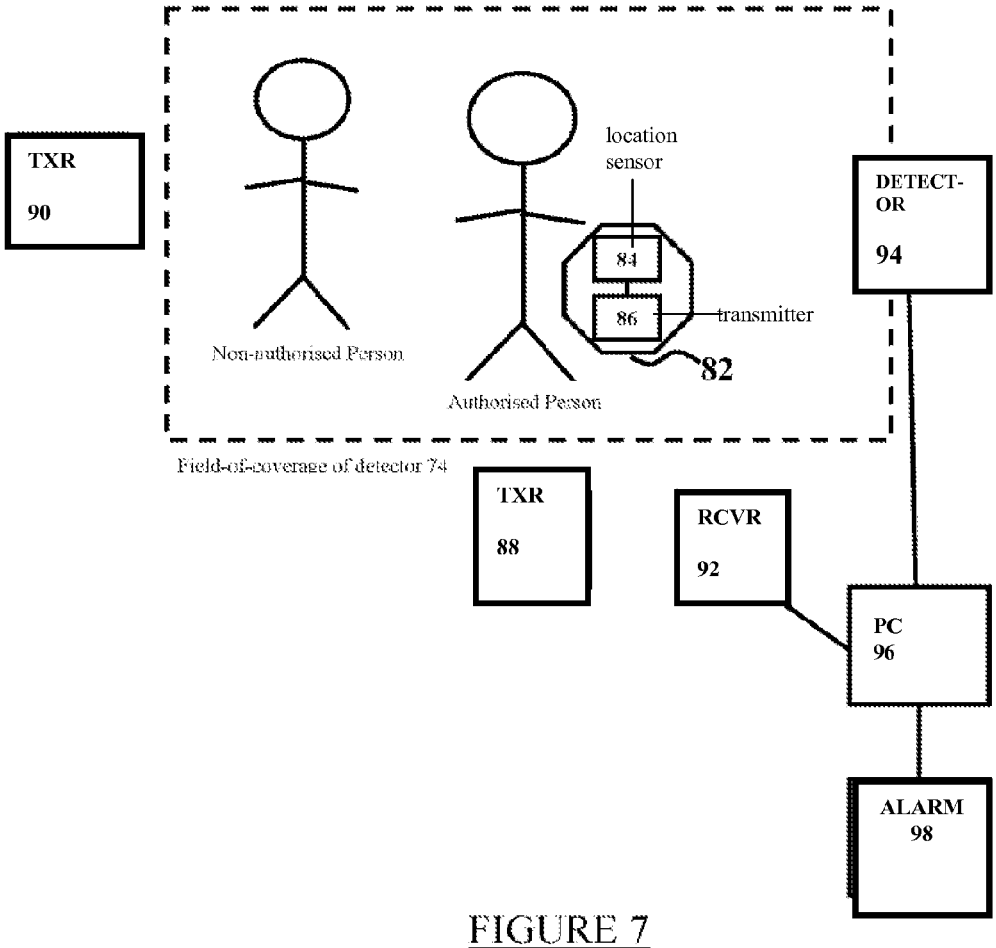
FIG. 7 shows a seventh embodiment of an intruder detection system.

In a sixth embodiment of the invention (shown in FIG. 7), the system is again capable of determining the number and locations of markers and unauthorized people within the area it covers. Authorized personnel carry a marker with a unique identifier 82, which comprises a location sensor 84 and a radio transmitter 86 and a 9V battery and power supply regulator (not shown). The location sensor 84 detects signals from a one or more location sensor transmitters 88, 90 placed in the environment, and a radio receiver 92 detects signals from the radio transmitter 86. The radio receiver 92 and a detector unit 94 are connected to an IBM-compatible PC 96, which, in turn, is connected to an alarm system 98. The preferred type of location sensor 84 and associated location sensor transmitters 88, 90 is an electromagnetic sensor and base stations such as the 'MiniBird 800' system manufactured by Ascension Technology Corporation of 107 Catamount Drive, Milton, Vt. 05468 U.S.A. The preferred type of radio transmitter 86 and radio receiver 92 is a 'SPM2-433-28' transceiver manufactured by Radiometrix Limited of Hartcran House, Gibbs Couch, Carpenders Park, Hertfordshire, WD19 5EZ, United Kingdom. The preferred type of detector unit 94 is a radar unit such as the short-range 24 GHz radar developed by smart microwave sensors GmbH of Mittelweg 7, Braunschweig, Niedersachsen D-38106, Germany.

When a marker 82 carried by an authorized person lies within range of the location sensor transmitters 88, 90, the marker determines its location and transmits it, together with the marker's unique identifier, via the radio transmitter 86. The software running on the PC 96 continuously monitors the output of the radio receiver 92 to determine the locations of markers carried by authorized personnel lying within range of the radio receiver 92. When the detector 94 signals the software running on the PC 96 to indicate that one or more people are present within its field-of-coverage, and passes the locations of those people to the PC software, the software checks the locations of the known authorized people against the locations of the people sensed by the detector 94. If the locations of one or more people sensed by the detector 94 are not matched by a corresponding marker location reported via the radio receiver 92, then an unauthorized person has entered the sensitive space, and so the software running on the PC 96 triggers the alarm system 98.

In some circumstances, a greater or lesser number of fixed transmitters 88, 90 will be required to cover the sensitive area monitored by the security system.

Other technologies may be substituted for the location sensor 84 and the fixed transmitters 88, 90, for example an ultra-wideband radio location sensor as developed by the applicant hereof or by Multispectral Solutions of 20300 Century Boulevard, Germantown, Md. 20874, U.S.A.

In all embodiments involving an active marker carried by authorized personnel, it may be advantageous to provide a mechanism to wake those markers from a low-power sleep state when they are in the vicinity of a sensitive space. In this way, the battery lifetimes of the markers are extended—each marker only consumes significant power whilst communicating information to the reader, and using this mechanism the marker only performs that action when it is likely to be able to communicate information to the reader.

Figure 8:
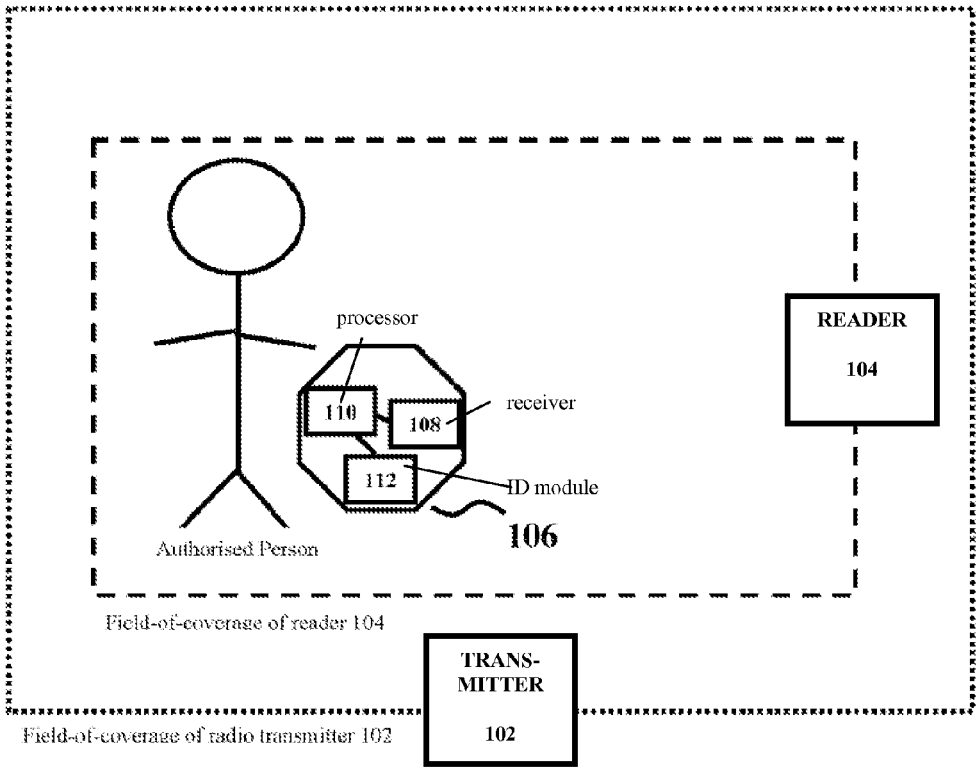
FIG. 8 illustrates a means for activating a marker from a low power state.

The accompanying FIG. 8 shows one way in which this mechanism may be implemented. A radio transmitter 102 is placed near the reader unit 104, and its power is adjusted so that the effective field-of-coverage of the reader unit 104 is contained within the effective field-of-coverage of the radio transmitter 102. Each marker 106 carried by an authorized person comprises a radio receiver 108, a processing means 110, an active identification module 112 (which may include location-determination functionality, as described in previous embodiments) and a power source (not shown).

In the low-power sleep state, the processing means 110 disables the active identification module 112, and samples (periodically or continuously) the output from the radio receiver 108. When the marker 106 is brought into range of the radio transmitter 102 (i.e. the marker 106 is in the vicinity of the reader unit 104), the processing means 110 will detect (either immediately, or with a small latency depending on the frequency of sampling of the radio receiver 108) a change in the output of the radio receiver 108, and will enable the active identification module 112 to allow correct operation of the security system. When the marker 106 leaves the vicinity of the reader unit, communications between the radio transmitter 102 and the marker's radio receiver 108 will no longer be possible, and the processing means 110 will detect the resulting change in the output of the radio receiver 108, and will disable the active identification module 112.

In all of the above embodiments of the system, a variety of alarm systems may be used to indicate that a security breach has occurred. The alarm system may, for example, be an audible or visible alarm, a door lock, a system which takes a picture of the area likely to contain the intruder and shows it to security staff or stores it for later examination, or, in circumstances where the detector unit can provide the alarm system with locations of unidentified and unauthorized targets, a system that slews a camera to point at that location so as to obtain a detailed image of the potential intruder. It is not necessary that an alarm be sounded in response to the alarm signal generated by the system.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

What is claimed is:

1. A system for monitoring the presence within a zone of persons having bodies, the system comprising:

one or more remotely detectable markers, each capable of being carried by a person;

a first sensor arrangement capable of identifying the presence of the body of at least one person within the zone and of characterizing the location of said body within the zone;

a second sensor arrangement capable of identifying the presence of at least one marker within the zone and of characterizing the location of said marker within the zone; and a processing arrangement responsive to the first sensor arrangement and the second sensor arrangement to generate an alarm signal if the first sensor arrangement identifies the presence of a body without the second sensor arrangement identifying a marker having a characterized location at which the body is identified.

2. A system as claimed in claim 1, wherein:

each marker has a unique identity;

the second sensor arrangement is capable of sensing the identity of marker that is located within the zone.

3. A system as claimed in claim 2, wherein the processing arrangement has access to a data store storing the identities of markers permitted in the zone and is arranged to generate an alarm signal if the identity of a marker sensed in the zone by the second sensor arrangement is not that of a marker that is permitted in the zone.

4. A system as claimed in claim 2, wherein:

the system comprises a third sensor arrangement for sensing an attribute of the or each person within the zone; and the processing arrangement has access to a data store storing for each marker one or more characteristics associated with that marker and is arranged to generate an alarm signal if the sensed attribute(s) do not correspond in a second predetermined manner to the characteristic (s) stored for the marker(s) sensed in the zone.

5. A system as claimed in claim 4, wherein the attribute is weight.

6. A system as claimed in claim 5, wherein the characteristic is an indication of the weight of a person associated with the respective marker.

7. A system as claimed in claim 5, wherein the characteristic is an indication of the type of a person associated with the respective marker, and the processing arrangement is arranged to estimate the weight of the person based on that indication.

8. A system as claimed in claim 5, wherein the second predetermined manner is such that if the weight sensed by the third sensing means differs by more than a predetermined threshold from the weight of the person as derived from the characteristic associated with the or each marker sensed in the zone then the sensed attribute does not correspond to the characteristic.

9. A system as claimed in claim 1, wherein the zone is such that only one person can be present in the zone at a time.

10. A system as claimed in claim 1, wherein the first sensor arrangement is capable of determining the number of bodies of people within the zone.

11. A system as claimed in claim 1, wherein a location is characterized as a bearing from a respective sensor arrangement.

12. A system as claimed in claim 1, wherein a location is characterized as a distance from a respective sensor arrangement.

13. A system as claimed in claim 1, wherein the zone is located at the periphery of a space, the first sensor arrangement is capable of identifying whether a body is moving towards or away from the space, and an alarm is generated if a body to which a marker does not correspond is moving towards the space.

14. A system as claimed in claim 1, wherein each marker has an active state and a low power state in which it uses less power than in the active state, and the system comprises means for causing the marker to enter the active state on entry into the zone.

15. A system as claimed in claim 1, wherein each marker is remotely detectable by means of radio frequency communication.

16. A system as claimed in claim 15, wherein each marker is a radio frequency transponder.

17. A method for monitoring the presence within a zone of persons having bodies by means of one or more remotely detectable markers, the method comprising:

identifying the presence of the body of at least one person within the zone and characterizing the location of said body within the zone;

identifying the presence of at least one marker within the zone and characterizing the location of that marker within the zone; and generating an alarm signal if the first sensor arrangement identifies the presence of a body without the second sensor arrangement identifying a marker having a characterized location at which the body is identified.

18. A system for detecting the presence of unauthorized persons within a zone, the system comprising:

one or more remotely detectable markers, each capable of being carried by a person;

a first sensor arrangement capable of identifying the presence of at least one person within the zone and of counting the number of persons identified within the zone;

a second sensor arrangement capable of identifying the presence of at least one marker within the zone and of counting the number of markers identified within the zone; and a processing arrangement responsive to the first sensor arrangement and the second sensor arrangement to generate an alarm signal if the number of persons identified by the first sensor arrangement does not correspond to the number of markers identified by the second sensor arrangement.

19. A system as set forth in claim 18, wherein said first sensor arrangement is further capable of characterizing the location within said zone of said at least one identified person, said second sensor arrangement is further capable of characterizing the location within said zone of said at least one identified marker, and said processing arrangement further generates an alarm signal if characterized locations of persons identified by said first sensor arrangement does not correspond to characterized locations of markers identified by said second sensor arrangement.

* * * * *